United States Patent [19]

Lonardi

[11] Patent Number: 4,893,735

[45] Date of Patent: Jan. 16, 1990

[54] APPARATUS FOR CONTROLLING HYDRAULIC JACKS MOUNTED ON A ROTARY HOPPER

[75] Inventor: Emile Lonardi, L-Bascharage, Luxembourg

[73] Assignee: Paul Wurth S.A., Luxembourg

[21] Appl. No.: 168,902

[22] Filed: Mar. 16, 1988

[30] Foreign Application Priority Data

Mar. 24, 1987 [LU] Luxembourg ..... 86823

[51] Int. Cl.[4] ..... B67D 5/64

[52] U.S. Cl. ..... 222/168; 222/503; 222/504; 222/506; 222/556; 222/560

[58] Field of Search ..... 222/502–506, 222/545, 556, 558, 559, 560, 168, 167; 105/240, 247, 248, 250, 253, 284, 286, 299, 306, 280; 298/35 R, 35 M, 37; 414/414, 328, 329, 419; 294/68.24

[56] References Cited

U.S. PATENT DOCUMENTS

| | | | |
|---|---|---|---|
| 3,072,295 | 1/1963 | Lovette | 222/504 X |
| 3,330,428 | 7/1967 | Gizeski | 222/504 X |
| 3,791,690 | 2/1974 | Garlinghouse | 294/68.24 |
| 3,866,799 | 2/1975 | Rikker et al. | 222/504 X |

FOREIGN PATENT DOCUMENTS

| | | | |
|---|---|---|---|
| 1190449 | 10/1959 | France | 222/504 |
| 718463 | 11/1954 | United Kingdom | 294/68.24 |

*Primary Examiner*—Joseph J. Rolla
*Assistant Examiner*—David H. Bollinger
*Attorney, Agent, or Firm*—Fishman, Dionne & Cantor

[57] ABSTRACT

The apparatus comprises a hydraulic unit mounted directly on the wall of the bottom of a rotary hopper and supplying hydraulic fluid to each of the jacks mounted on the hopper wall. This hydraulic unit is connected to an energy source on a fixed bracket located in the region of the bottom of the hopper, but which is independent therefrom. As the rotary hopper rotates, the hydraulic unit retains its connection with the energy source. The energy source activates the hydraulic unit, which subsequently opens the hopper.

10 Claims, 3 Drawing Sheets

APPARATUS FOR CONTROLLING HYDRAULIC JACKS MOUNTED ON A ROTARY HOPPER

BACKGROUND OF THE INVENTION:

This invention relates to an apparatus for controlling hydraulic jacks mounted on a rotary hopper for a loading installation of a shaft furnace.

It is well known that granular charging or loading material for use in a shaft furnace will undesirably segregate according to their granulometry when disposed in a stand-by hopper. In an effort to reduce this phenomenon of segregation in accordance with their granulometry (particularly during the filling of a hopper), it is known to cause the hopper to rotate about its vertical axis during filling and also, if appropriate, during emptying. However, the rotation of the hopper presents problems with regard to the delivery of hydraulic fluid to hydraulic jacks which are used on the hopper to actuate the valves shutting off the bottom out flow orifice of the hopper In fact, on the top of the hopper and in the axis of rotation thereof, rotary connections which are supported by cross members must be placed on the upper edge of the hopper. These rotary connections are connected between a pair of hydraulic fluid pipes and feed pipes passing along the outside of the hopper to the jacks actuating the valves. It will be appreciated that such pipes obstruct the upper orifice of the hopper, particularly during the filling of the hopper. In addition, the rotary connections are always subject to risks of leakage and need special monitoring. This is especially true because the connections have to be arranged in a region where they are necessarily exposed to impact by the material during the loading of the hopper.

SUMMARY OF THE INVENTION:

The above-discussed and other drawbacks and deficiencies of the prior art are overcome or alleviated by the novel apparatus for controlling hydraulic jacks of the present invention which do not have the disadvantages discussed above. In accordance with the present invention, an apparatus for controlling hydraulic jacks mounted on a rotary stand-by hopper of a loading installation for a shaft furnace is provided wherein, in a preferred embodiment, the hydraulic unit is mounted directly on the wall of the bottom of the hopper and supplys hydraulic fluid to each of the jacks. In addition, the hydraulic unit is connected to an energy source on a fixed bracket located in (but independent of) the region of the bottom of the hopper.

In accordance with a preferred embodiment of the present invention, the hydraulic unit comprises a hydraulic pump, the piston of which is connected to one of the ends of a rocker which is carried by a support fastened to the wall of the rotary hopper. The other end of the rocker carries a roller travelling in a guide rail. The center of curvature of the guide rail is along the axis of the hopper and is vertically shiftable along the bracket under the action of one or more hydraulic jacks mounted on the bracket.

The guide rail can extend over a limited angular sector or can completely surround the hopper over 360°. In the first case, the hopper cannot rotate while the valve is being actuated and must be stopped in a specific angular sector so that the valve can be actuated. In contrast, in the second case, the hopper can rotate while the valve is being actuated.

The above-discussed and other features and advantages of the present invention will be appreciated and understood by those of ordinary skill in the art from the following detailed description and drawings.

Figure 1:
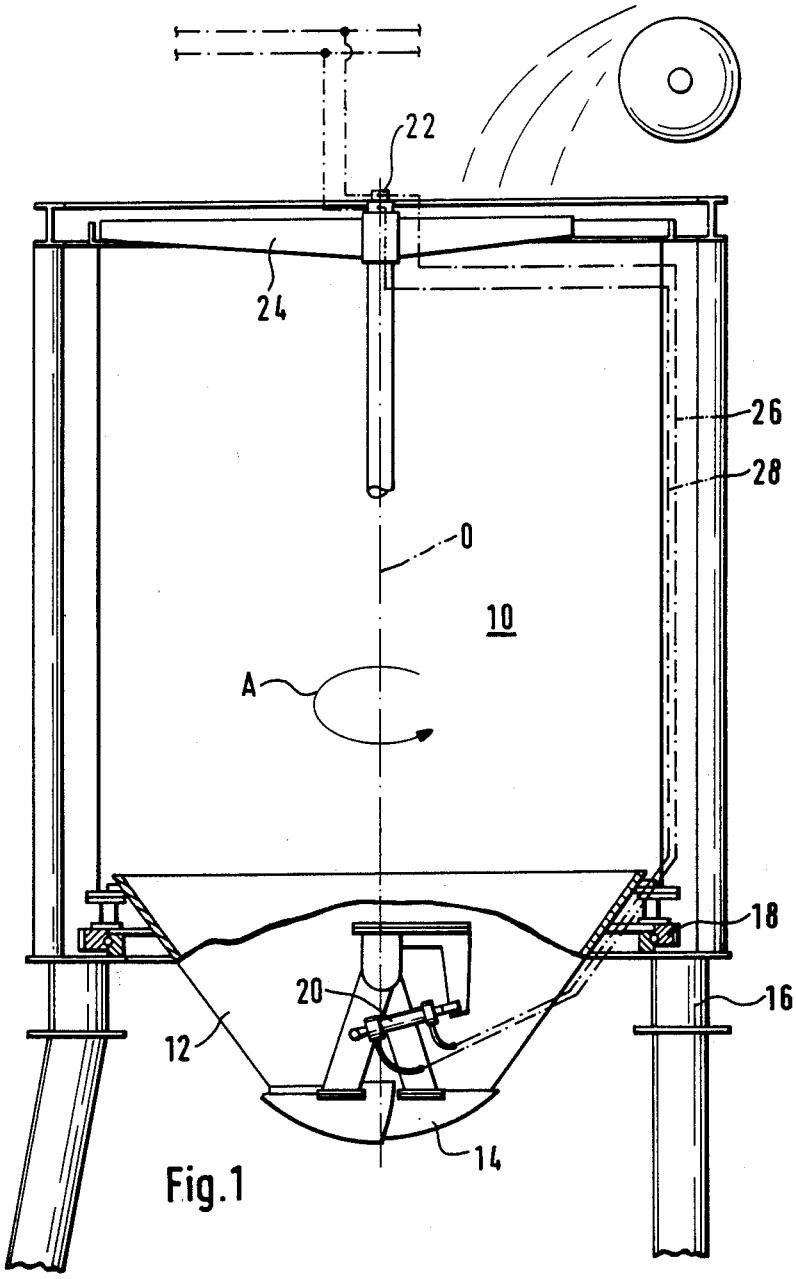
FIG. 1 is a side elevation view, partly in cross section, of a rotary hopper with hydraulic fluid feed in accordance with known prior art.

DESCRIPTION OF THE PREFERRED EMBODIMENT:

Referring first to FIG. 1, a hopper is shown diagrammatically at 10 which, in the example illustrated, is a stand-by hopper for a loading installation of a shaft furnace. Hopper 10 comprises a cylindrical wall and a funnel shaped bottom 12, the outflow orifice of which is controlled by means of a valve 14. Hopper 10 rests on a supporting reinforcement 16 by means of a rolling ring 18 which allows it to be rotated about its vertical axis (this being symbolized by the arrow A). Reference numeral 20 denotes a hydraulic jack for actuating valve 14. It will be appreciated that a similar jack is located on the opposite side of the figure (not shown).

In view of the ability of hopper 10 to rotate the supply of hydraulic fluid to jacks 20 presents certain problems. As shown in FIG. 1, the prior art attempted to solve this problem by providing in the upper part of hopper 10, on the central vertical axis 0, rotary connections 22, supported by crossmembers 24 placed on the end of the hopper. Connections 22 are connected to a pair of fixed pipes. On the outside of hopper 10, connections 22 are connected to each of the jacks actuating the valve 14 by means of pipes 26, 28 rotating with the hopper. As discussed in the Background Section, the prior art mechanism suffers from certain drawbacks and deficiencies.

Figure 2:
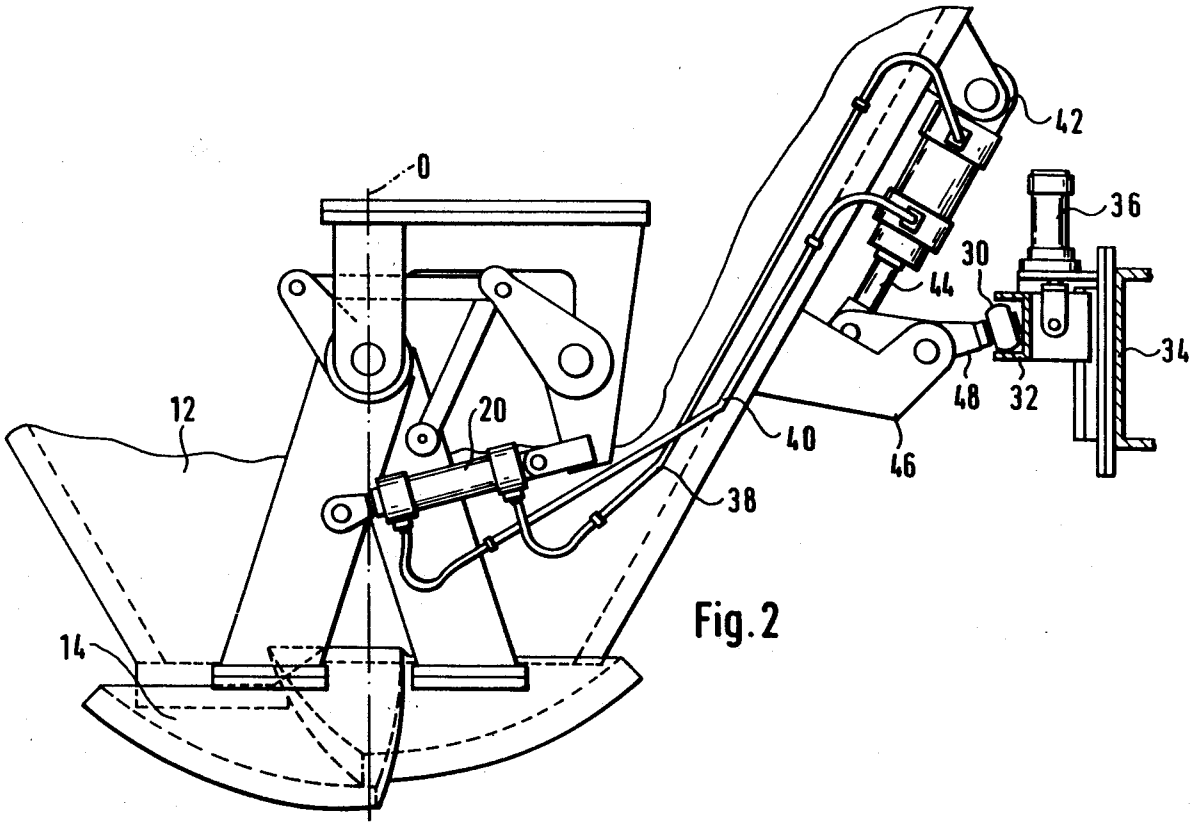
FIG. 2 is a diagrammatic side elevation view of the lower part of a hopper with a control apparatus in accordance with the present invention.
Figure 3:
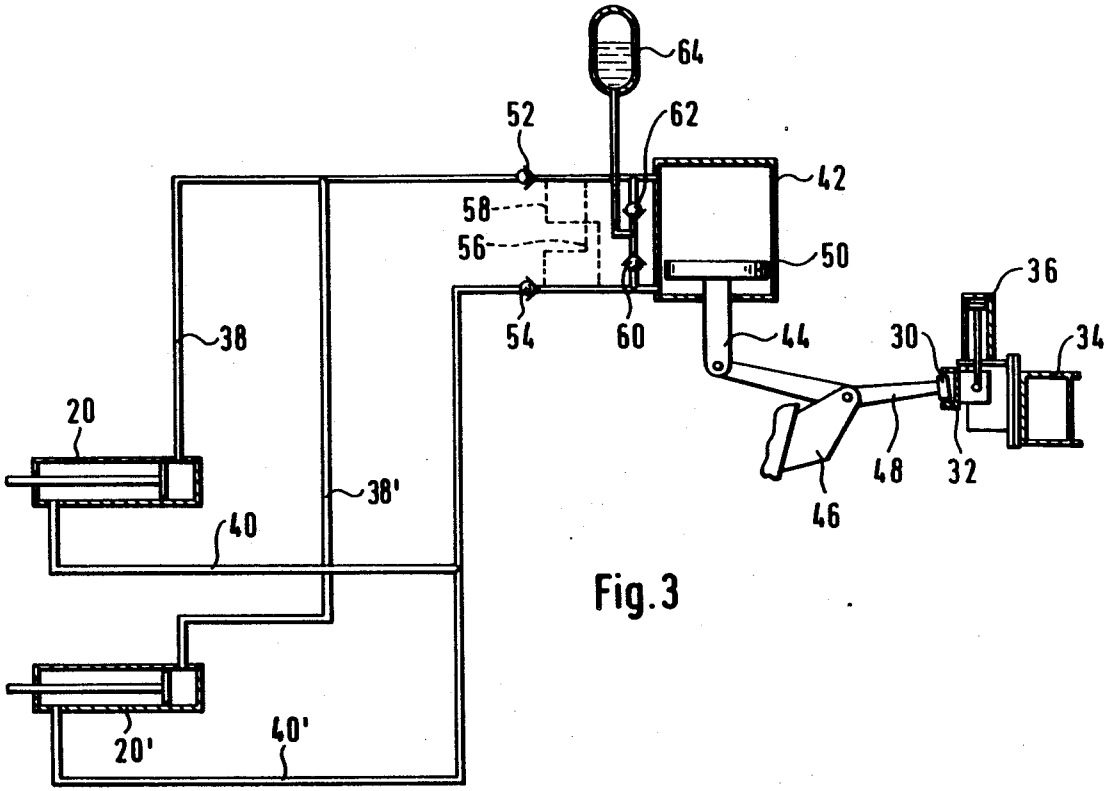
FIG. 3 is a diagrammatic side elevation view of a hydraulic control circuit for actuating two hydraulic jacks.

To avoid the need for rotary connections and distributing pipes located in the upper hopper loading zones; and for the supporting arms which are subjected to wear and which influence the path of the material loaded into the hopper, the present invention provides an apparatus for controlling the jacks which is located in the region of the bottom 12 of hopper 10 (see FIG. 2). FIG. 3 shows the details of a preferred embodiment of such a control apparatus.

The valve 14 shown in FIG. 2 is comprised of two registers which are provided with symmetrical cut-outs and which are actuated in opposite directions in order to define a variable out flow orifice about the hopper axis 0. The suspension mechanism of the two registers and their drive means are not part of the present invention, because this can apply to other types of valves which are actuated in a different way. It is merely pointed out that one of the registers is actuated by two jacks mounted respectively on either side of the bottom 12 of hopper 10, and it is this register which transmits the movement to the other register by means of a linkage. This suspension mechanism is more fully described in U.S. application Ser. No. 168,973, now U.S. Pat. No. 4,844,292, filed on the same day as the present application and corresponding to Luxembourg Application 86 821 filed on Mar. 24, 1987.

Hydraulic jack 20 is connected by means of pipes 38 and 40 to a hydraulic pump 42, to which the jack (not seen and located on the hidden side of FIG. 2) is likewise connected. This hydraulic pump 42 is fastened to the wall of hopper bottom 12 and consequently rotates together with bottom 12 about the axis 0. A rocker 48 is pivotably mounted on a support 46 which is also fastened to the wall of hopper 12. One of the ends of rocker 48 is articulated on the end of a piston rod 44 of pump 42. The other end of rocker 48 carries a roller 30 which travels in a rail 32 mounted on a fixed bracket 34. Rail 32 is vertically shiftable along bracket 34 under the action of a hydraulic jack 36. The actuation of jack 36 consequently causes rail 32 to be raised or lowered. The vertical movement of rail 32 thereby results in a pivoting of rocker 48 which makes it possible to actuate hydraulic pump 42.

It will be appreciated that rail 32 must have a curvature corresponding to the path of roller 30 during the rotation of hopper 12. In other words, the center of curvature of rail 32 must be on the vertical axis 0 of the hopper. If rail 32 extends around the bottom 12 of the hopper over 360°, the hopper can rotate while valve 14 is being actuated. In such an embodiment, there must be several jacks 36 around hopper 12 in order to actuate rail 32.

It is also possible for rail 32 to have only a specific length corresponding to a certain angular sector about the hopper. In this latter case, the hopper cannot rotate while valve 14 is being actuated, and it has to be stopped at a specific angular position, in which roller 30 is engaged in guide rail 32.

The mode of operation of the hydraulic control apparatus of FIG. 2 is illustrated diagrammatically in FIG. 3. When rocker 48 is pivoted in a clockwise direction as a result of the lowering of guide rail 32, the piston 50 of pump 42 conveys oil under pressure via a non-return valve 52 into the pipes 38 and 38' of the jacks 20 and 20'. The rods of jacks 20 and 20' are thus released in order to open the valves. The pressure in pipes 38 and 38' is transmitted, via a pipe 56, to a non-return valve 54 located in the return pipe, to which are connected the pipes 40 and 40.. The pressure in pipe 56 opens this non-return valve 54, thus allowing oil to return to the lower compartment of pump 42 via pipes 40 and 40'.

The valve is closed in a similar way, with the functions of pipes 38, 38' and 40, 40' respectively, being reversed. During this closing phase, rocker 48 is actuated in a counter-clockwise direction in order to convey oil through pipes 40 and 40'. The pressure in these pipes is transmitted via pipe 58 to the non-return valve 52 in order to open it and allow the oil to return to pump 42 via pipes 38 and 38'.

A pressure oil tank is identified at 64 which automatically distributes oil to one or the other of the two circuits of pump 42 via the non-return valves 60 and 62, as soon as there is a lack of it; for example, as a result of leaks at the piston and at the rod.

The oil volume of pump 42 can be slightly greater than the volume of jacks 20 and 20', in order to guarantee a maximum stroke of the latter. The dimensions of the jacks 20, 20' and 36, and of the pump 42, and the ratio of the lever arms of the rocker 48 should be selected by a person of ordinary skill in the art to be in accordance with the forces required to actuate valve 14.

It should be noted that pump 42 can be actuated by means other than those illustrated in FIGS. 2 and 3. For example, pump 42 could be actuated by an electric motor similarly fastened to the wall of hopper 12, the motor being fed with electrical current from circular slip rings.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for controlling hydraulic jacks, comprising:

a support member;

a rotary hopper, rotatably mounted on the support member, said hopper having an outer wall and a bottom portion;

a plurality of hydraulic jacks mounted directly on the rotary hopper;

a hydraulic unit mounted directly on said outer wall of the bottom portion of said hopper, said hydraulic unit including means for supplying hydraulic fluid to said hydraulic jacks; and energy source means for actuating said hydraulic unit, said energy source means located adjacent to said bottom portion of said hopper, but being independent from said bottom portion.

2. Apparatus according to claim 1 wherein said hydraulic unit comprises:

a hydraulic pump having a piston rod;

a rocker having opposed first and second ends, said piston rod being pivotally connected to said first end of said rocker;

a support mounted on the outer wall of said hopper, said rocker being pivotably mounted on said support;

a guide rail surrounding at least a portion of said hopper and having a center of curvature corresponding to the central axis of said hopper, said guide rail being vertically shiftable along said fixed bracket via said energy source means; and a roller movable along said guide rail, said second end of said rocker being connected to said roller.

3. Apparatus according to claim 2 wherein:

said energy source means comprises at least one hydraulic jack.

4. Apparatus according to claim 2 wherein:

said guide rail surrounds only a limited portion of said hopper.

5. Apparatus according to claim 2 wherein:

said guide rail completely surrounds said hopper.

6. Apparatus according to claim 1, further comprising:

tank means for containing hydraulic fluid under pressure; and means for conveying said fluid automatically into said means for supplying hydraulic fluid to said hydraulic jacks.

7. An apparatus for controlling hydraulic jacks, comprising:

a support member;

a rotary hopper, rotatably mounted on the support member, said hopper being an outer wall and a bottom portion;

a plurality of hydraulic jacks mounted directly on the rotary hopper;

a hydraulic unit mounted directly on said hydraulic unit on said outer wall of the bottom portion of said hopper, said hydraulic unit comprising:

a hydraulic pump having a piston rod;

a rocker having opposed first and second ends, said piston rod being pivotably connected to said first end of said rocker;

a support mounted on the outer wall of said hopper, said rocker being pivotably mounted on said support;

a guide rail surrounding at least a portion of said hopper and having a center of curvature corresponding to the central axis of said hopper, said guide rail being vertically shiftable along said fixed bracket via said energy source means;

a roller movable along said guide rail, said second end of said rocker being connected to said roller; and means for supplying hydraulic fluid to said hydraulic jacks; and energy source means for actuating said hydraulic unit, said energy source means located adjacent to said bottom portion of said hopper, but being independent from said bottom portion.

8. The apparatus of claim 7, wherein the energy source means comprises at least one hydraulic jack.

9. The apparatus of claim 7, wherein the guide rail surrounds only a limited portion of the hopper.

10. The apparatus of claim 7, wherein the guide rail completely surrounds the hopper.

* * * * *